US005138929A

United States Patent [19]

Weldon et al.

[11] Patent Number: 5,138,929

[45] Date of Patent: Aug. 18, 1992

[54] RAILGUNS WITH CURRENT GUARD PLATES

[75] Inventors: William F. Weldon, Austin, Tex.; Joseph H. Beno, Herndon, Va.

[73] Assignee: Board of Regents, The University of Texas System, Austin, Tex.

[21] Appl. No.: 707,953

[22] Filed: May 22, 1991

Related U.S. Application Data

[62] Division of Ser. No. 459,993, Jan. 2, 1990, abandoned.

[51] Int. Cl.[5] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 4,200,831 | 4/1980 | Weldon et al. | 322/18 |
| 4,347,463 | 8/1982 | Kemeny et al. | 318/135 |
| 4,433,608 | 2/1984 | Deis et al. | 89/8 |
| 4,449,441 | 5/1984 | McAllister et al. | 89/8 |
| 4,577,545 | 3/1986 | Kemeny | 89/8 |
| 4,608,908 | 9/1986 | Carlson et al. | 89/8 |
| 4,677,895 | 7/1987 | Carlson et al. | 89/8 |
| 4,714,003 | 12/1987 | Kemeny | 89/8 |
| 4,733,595 | 3/1988 | Oberly | 89/8 |
| 4,796,511 | 1/1989 | Eyssa | 89/8 |

FOREIGN PATENT DOCUMENTS

| | | | |
|---|---|---|---|
| 138488 | 7/1985 | Japan | 89/8 |

OTHER PUBLICATIONS

Thio et al., "Feasibility Study of a Railgun as a Driver for Impact Fusion", DOE/ER/13048-3, Jun. 1986, pp. 6-31-6-33.

Deis, D., et al., "EMACK Electromagnetic Launcher Commissioning", *IEEE Transactions on Magnetics*, 20:2, (Mar. 1983), pp. 245-258.

Drake, P., et al., "Two-Dimensional Current Diffusion in an EML Rail with Constant Properties", *IEEE Transactions on Magnetics*, 22:6, (Nov. 1986), pp. 1448-1452.

Fair, N., "Electromagnetic Propulsion: A New Initiative", *IEEE Transactions on Magnetics*, 18:1, (Jan. 1982), pp. 4-6.

Kerrisk, J., "Current Distribution in Inductance Calculations for Rail-Gun Conductors", *Los Alamos National Laboratory Report*, LA-9092-MS, (Nov. 1981).

Leuer, J., "Electromagnetic Modeling of Complex Railgun Geometries", *IEEE Transactions on Magnetics*, 22:6, (Nov. 1966), pp. 1584-1590.

Kotas et al., "A Parametric Evaluation of Railgun Augmentation", *IEEE Transactions on Magnetics*, 22:6, (Nov. 1986), pp. 1573-1577.

Long, G., "Railgun Current Density Distributions", *IEEE Transactions on Magnetics*, 22:6, (Nov. 1986), pp. 1597-1602.

Young, F., et al., "Rail and Armature Current Distributions in Electromagnetic Launchers", *IEEE Transactions on Magnetics*, 18:1, (Jan. 1982), pp. 33-41.

Barber, J., "Metal Armature Critical Issues", Proceedings of the First EM Gun Armature Workshop, Eglin, Fla., Air Force Armament Laboratory, Eglin AFB, (Jun. 1986).

Craddock, E., et al., "Thermal Analysis of Fiber Armatures", *IEEE Transactions on Magnetics*, 24:1, (Jan. 1989), pp. 127-132.

Marshall R., "Current Flow Patterns in Railgun Rails", *IEEE Transactions on Magnetics*, 20:2, (Mar. 1984), pp. 243-244.

Price, J., et al., "Design and Testing of Large Bore, Ultra-Stiff Railguns", *IEEE Transactions on Magnetics*, 25:1, (Jan. 1989), pp. 460-466.

Beno, "An Investigation into the Potential for Multiple Rail Railguns", *IEEE Transactions on Magnetics*, 25:1, (Jan. 1989), pp. 92-96.

*Primary Examiner*—Stephen C. Bentley

*Attorney, Agent, or Firm*—Arnold, White & Durkee

[57] ABSTRACT

An electromagnetic projectile launcher or railgun capable of withstanding hundreds or thousands of shots. The railgun features a current management system having guard plates which act to reduce peak rail current densities while also maximizing projectile velocity. Guard plates can be used in either square or round bore designs and can be powered by either a single or separate power supply from that of the rails.

2 Claims, 10 Drawing Sheets

RAILGUNS WITH CURRENT GUARD PLATES

The U.S. Government may have rights in this invention pursuant to funding arrangements with the Department of Defense.

This is a divisional of application Ser. No. 07/459,993 filed Jan. 2, 1990, now abandoned.

BACKGROUND OF THE INVENTION

This invention relates electromagnetic projectile launchers or railguns incorporating current guard plates to minimize railgun damage while maximizing projectile velocities.

Electromagnetic projectile launchers or railguns are of potential interest for military applications as a means for firing projectiles at high velocities. Conventional railguns involve a short duration launch of a high energy projectile. Common projectile energies are in the range of 1-20 megajoules and launch times are 1-10 milliseconds. This dictates that useful railguns operate as pulsed current devices, driven by pulsed power supplies. In order to maximize projectile acceleration, rail current densities must be very high.

When applying electromagnetic railgun technology to military applications, it becomes necessary to propel a large projectile, often as large as a 90 millimeter, 2 kilogram armor-penetrating shell, at supersonic velocities exceeding 2 km/s. However, in doing so, rapid rates of fire and railgun durability must be sustained. Typically, today's high energy railguns display unacceptable railgun damage during a single shot. Continuous-shot railguns, therefore, cannot be achieved. Both the projectile and the rails experience substantial melting and material vaporization. The result is that the railguns require new rails or rail honing after just a few shots.

As railgun development continues toward higher energy devices capable of firing larger projectiles, more progress must be made in two aspects of railgun design. First, railguns must be made capable of sustaining hundreds if not thousands of shots without any major heat related damage. Second, the railguns must be made capable of handling increased pulsed energies needed to propel massive projectiles at higher velocities without significant increases in rail damage caused by high local current densities. Both aspects are related in that they primarily represent direct effects of railgun current and its resulting current distribution in the rails.

Rail damage is principally caused by high current densities transferred from the current carrying rails to the sliding conductive armature or projectile. Most of the damage is heat-related. The sources of the heat-related damage are: 1) heat generated by the rail-armature interface contact voltage drop; 2) Joule heating from the current in the rails; and 3) friction heating. The first two sources of damage are strongly dependent on the local current density. Because the distribution of rail current naturally concentrates in the vicinity of sharp rail corners, previous railguns have attempted to reduce rail damage by designing rails with rounded corners. Unfortunately, designing rails with rounded corners has produced only limited success. Significant current densities and accompanying railgun damage still exist. Railguns capable of withstanding hundreds or thousands of shots have thus far not been produced using conventional rounded-rail techniques.

Some known railgun designs use augmenting conductors to increase the electromagnetic force placed on a projectile. Augmenting conductors increase the inductance gradient in the railgun bore thereby achieving comparable projectile acceleration forces at substantially reduced currents. The augmenting conductors are conductive elements placed external to, and parallel with, the external surfaces of the railgun rails. When coupling a power supply to both the rails and the augmenting conductors in series, projectile force and inductance gradient in a square or round-bore railgun can be increased as demonstrated in numerical examples summarized below in Table I.

TABLE I

Augmented Square and Round-Bore Railgun Performance

| | Force (MN) | Current (MA) | Inductance Gradient (MH/m) |
|---|---|---|---|
| Square Bore | 0.393 | 1.224 | 0.525 |
| Augmented Square-Bore | 0.543 | 0.961 | 1.175 |
| Round-Bore | 0.346 | 1.184 | 0.494 |
| Augmented Round-Bore | 0.316 | 0.710 | 1.252 |

Results presented in Table I are for square and round-bore railguns shown in FIGS. 1, 3 and 5. In Table I, the square-bore railgun of FIG. 1 has an inside rail separation, b, of 4.0 cm, each rail has a height, $h_r$, of 4.0 cm and a thickness, t, of 1.0 cm. When augmenting conductors are added, as shown in FIG. 3, each augmenting conductor is placed 2.0 mm outside the outer edge of each inside rail. Each augmenting conductor has 8.0 cm height, $h_g$, and 1.0 cm thickness, t. Meanwhile round-bore railguns having an arcuate rail and an arcuate augmenting conductor is shown in FIG. 5. For the numerical examples of Table I, angle a is 45°, railbore diameter, $r_b$, is 2.257 cm, rail and augmenting conductor thicknesses, t, are 1.0 cm and separation distance, d, is 2.0 mm. Table I figures for force, current, and inductance gradiant were derived using the aforementioned geometries for square-bore, augmented and non-augmented, railguns and round-bore, augmented and non-augmented railguns. The geometrical differences between square-bore and round-bore railguns are held constant so that the comparisons shown in Table I can be accurate.

While augmenting conductors increase projectile force, conventional augmented designs exacerbate current distribution problems. For a given quantity of total railgun current, the increased force obtainable from conventional augmented railguns incurs the liability of increased rail peak current densities along the inside corners of the rails. For continuous-shot railguns, the resulting rail damage would be unacceptable. Thus, the need arises to combine the effects of augmenting conductors with means of reducing local rail current densities usable in a continuous-shot railgun application.

SUMMARY OF THE INVENTION

The present invention manages current distribution by actively shaping railgun currents into a more favorable distribution on the rails, while maintaining high projectile force. To achieve the desired result, the present invention uses generally C-shaped auxiliary conductors, or guard plates, having inner surfaces adjacent to, and of equal distance from, selected rail surfaces. The guard plates are disposed external to the rail bore and substantially parallel to the bore central axis. In a square bore railgun, the guard plates are generally parallel to the outside, top and bottom surface of the rails, and extend along the entire length of the rail bore. In a round bore railgun, the guard plates are situated adjacent to and equa-distant from all rail surfaces except for the inside rail surface adjacent the rail bore. The guard plates also preferably extend along the entire length of the rail bore. The advantage of the guard plates of the present invention is that they serve two simultaneous functions required for modern military application: 1) they minimize local peak current density thereby reducing rail damage, while 2) maximizing projectile acceleration force.

The guard plates serve an initial function as a current distribution system capable of dispersing current more evenly along the rail surfaces. By having the guard plates partially surround or wrap around non-internal rail surfaces, the electrical current flowing in the guard plates interacts with the rail currents to force more uniform distribution of current across the entire rail surface. The guard plates function to reduce peak current density at the inside rail corners where heating is a problem and on the sides and back of the rails where it complicates armature design, and forces more uniform current distribution across the inside rail surface where it is most effective.

Guard plates not only function as current distributors, but they also have an added benefit of being able to amplify electromagnetic force applied to the projectile. When the guard plates carry current in the same direction as the rail they partially surround, the added total current can increase projectile force 6–7 times that obtainable with conventional augmented railguns, but with the added benefit of not increasing current densities at the inside rail corners. This represents a substantial improvement over conventional augmented designs.

The advantages of guard plate designs can be further appreciated in a round-bore design where the guard plates surround the rails on all surfaces except the interior, bore surface. Both the rails and the guard plates are arcuate and extend inward at the edges to define a round bore. At both ends of the guard plate, the interior surface can be made to extend radially inward flush with the interior surface of the rails or it can extend inward beyond the interior rail surface and into the rail bore area. The latter design, or "overhang" design further aids in reducing current densities at the corners of the interior rail surface.

The guard plates can be powered from the same pulsed power source as that used to power the rails, or the guard plates can be powered from a separate power source. In addition, the guard plates can be segmented in order to further enhance the advantageous current distribution effects of the present invention.

Further objects, features, and advantages of the present invention will be apparent from the following detailed description when taken in conjunction with the accompanying drawings.

DETAILED DESCRIPTION OF THE PREFERRED EMBODIMENTS

Figure 1:
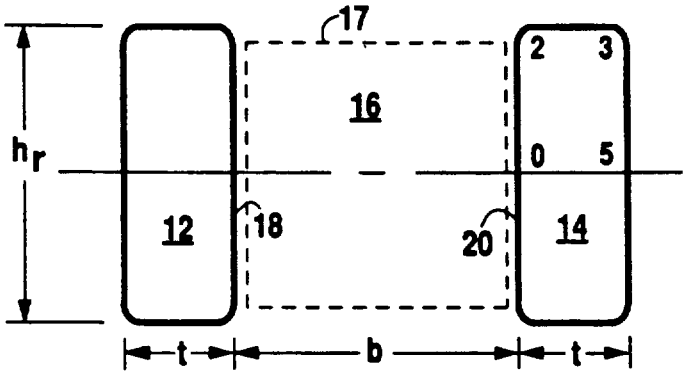
Fig. 1 PRIOR ART
FIG. 1 is an end view of a prior art electromagnetic projectile launcher having parallel rails defining a square bore.

Referring to the drawings, FIG. 1 is an end view of a prior art electromagnetic projectile launcher. Parallel rails 12 and 14 define a square bore 16 through which conductive projectile 17 is propelled. The rails are electrically connected so that projectile 17 is forced down the length of the bore 16 in slideable contact with inside surfaces 18 and 20 of rails 12 and 14, respectively. As projectile 17 is electromagnetically thrust along the length of bore 16, a current path is formed at the rail-to-projectile interface with large current densities at the inside surface 18 and 20 of both rails 12 and 14.

Figure 2:
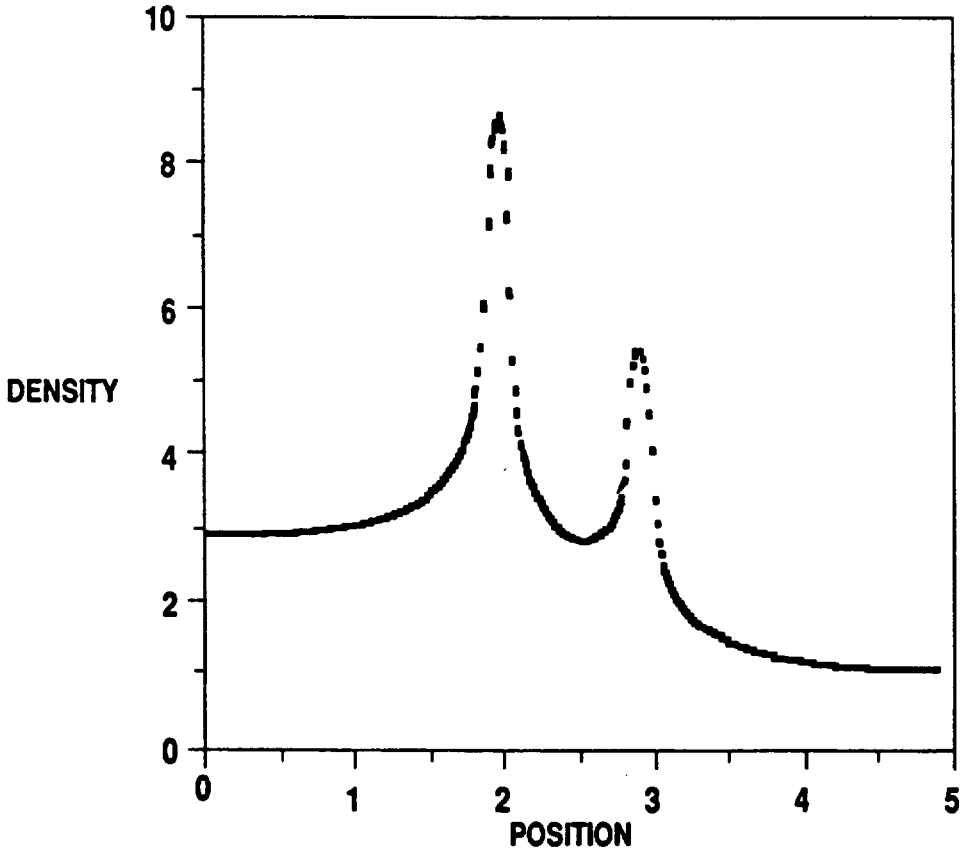
Fig. 2 PRIOR ART
FIG. 2 is a graph of a numerical example of normalized peak current density along the rail surface of the launcher of FIG. 1.

FIG. 2 is a numerical example of a plot of normalized current density on the surface of the top half of right rail 14 of the square-bore configuration of FIG. 1. The "position" is established at the center of the inside surface 20 of rail 14 and is clockwise incriminated around the surface of the rail. Ending position 5 is the center of the outside surface of the right rail 14. Referring to both FIG. 1 and FIG. 2, position 0 is the middle inside surface, and position 5 is the middle outside surface of rail 14. To facilitate comparison, these positions are used consistently in FIGS. 1–12. With the current density at position 5 being assigned a magnitude of 1, the graph of FIG. 2 is normalized to indicate the current magnitude at the various positions indicated. All plots hereinafter indicated are normalized in the same manner. As shown in FIG. 2, conventional square bore railguns have an inherently high peak current density at the corners of the rails (i.e., positions 2 and 3). Rail 12 will demonstrate the same characteristics as rail 14, and the lower half of the rails demonstrate the same characteristics as the upper half, the lower inside and outside corners will also have high current densities.

Figure 3:
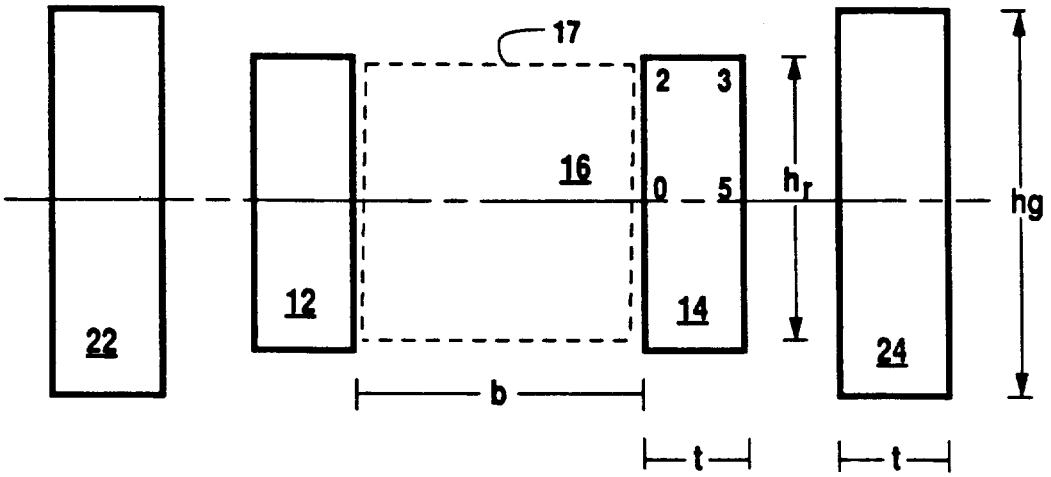
Fig. 3 PRIOR ART
FIG. 3 is an end view of a prior art square bore electromagnetic projectile launcher having augmenting conductors.

FIG. 3 is an end view of a prior art electromagnetic projectile launcher having augmenting conductors 22 and 24. Augmenting conductors 22 and 24 are placed parallel with, separate from, and external to, rails 12 and 14. Conventional augmented railguns are electrically coupled in series. A typical current flow begins at the breech end of the right hand augmenting conductor 24, flows to the muzzle end, jumps to the left hand augmenting conductor 22 where it returns to the breech, then down the right rail 14, across projectile 17 and back to the breech via the left rail 12. This results in the augmenting conductors carrying the same current polarity as the adjacent rails, the total current carrying capability of the railgun being effectively increased. A higher total current will produce a stronger electromagnetic field in the bore of the railgun and result in a greater electromagnetic force on projectile 17 enabling projectile 17 to be propelled at a greater velocity than that in a standard, non-augmented design of FIG. 1.

Figure 4:
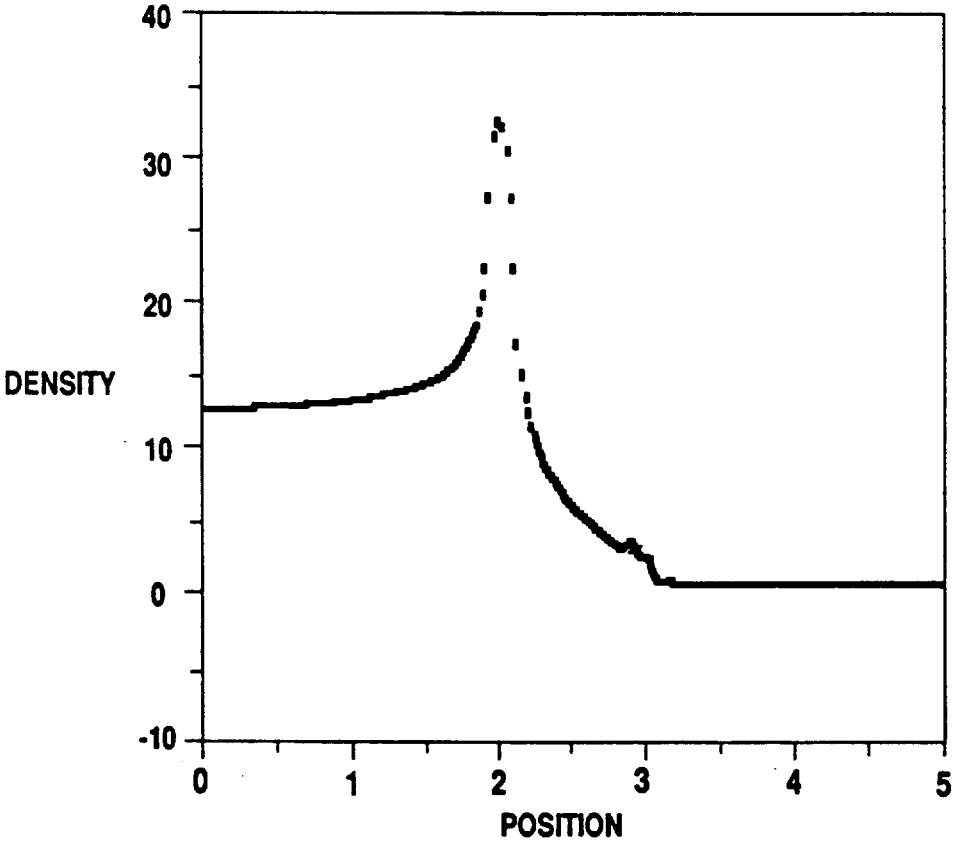
Fig. 4 PRIOR ART
FIG. 4 is a graph of a numerical example of normalized peak current density along the rail surface of the launcher of FIG. 3.

FIG. 4 is a graph of a numerical example of the normalized current density along the upper half of the right-hand rail 14 of the augmented railgun of FIG. 3. As indicated by the graph, peak current densities exist at position 2, at the inside corner of the rails. Although they increase projectile forces, conventional augmenting conductors exacerbate the current density problem. As shown in FIG. 4, the current density at position 2 is nearly 35 times that of the current at position 5. For continuous-shot railguns, such an uneven current density distribution would be unacceptable. Extensive rail damage would occur at the inside corners of the rails after only a few shots.

Figure 5:
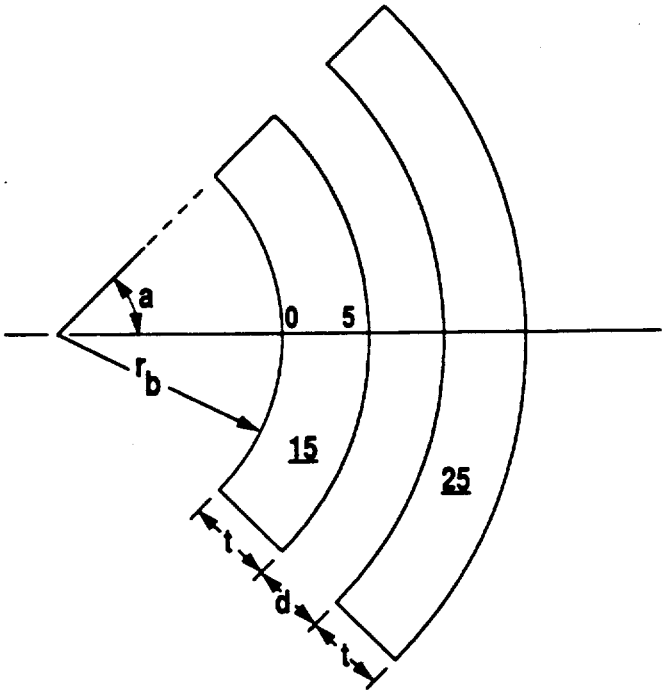
Fig. 5 PRIOR ART
FIG. 5 is an end view of half of a prior art round bore electromagnetic projectile launcher having an arcuate augmenting conductor.
Figure 6:
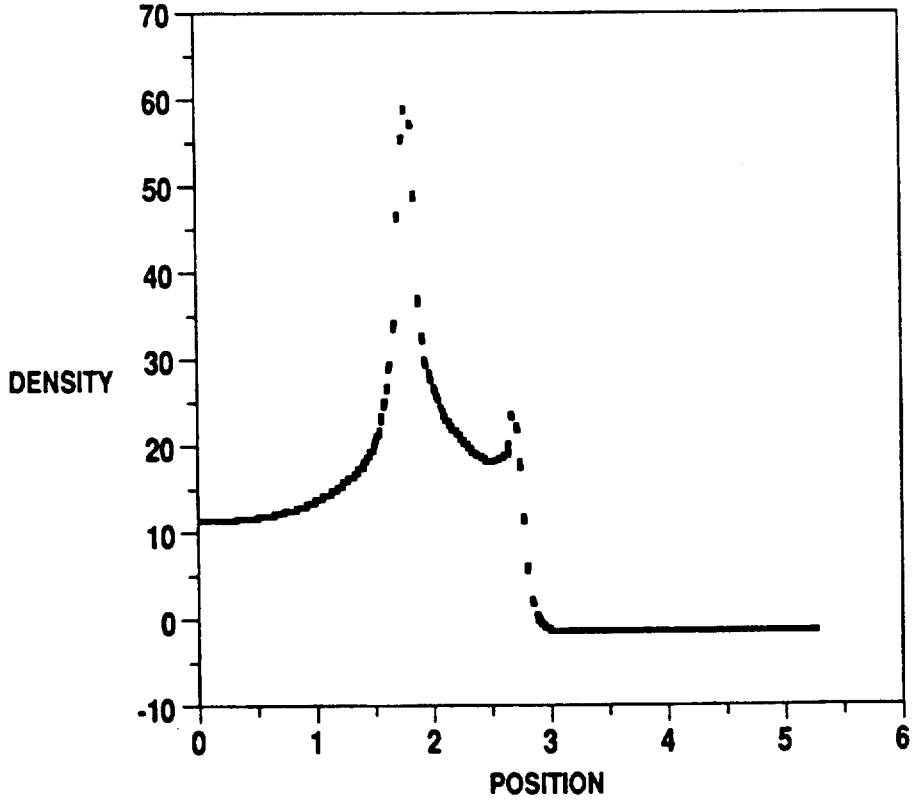
Fig. 6 PRIOR ART
FIG. 6 is a graph of a numerical example of normalized peak current density along the arcuate rail surface of the launcher of FIG. 5.

The conventional augmenting design can also be used in a round-bore embodiment. FIG. 5 illustrates an end view of a right-hand arcuate rail 15 and augmenting arcuate conductor 25 of a round-bore railgun. The right augmenting conductor 25 is placed separate from, and external to, the right rail 15. As with the square-bore design, FIG. 6 shows that the round-bore augmented design demonstrates a large peak current density at the inside corners of rail 15. The peak current density at the inside corner is over 60 times that of position 5. Such a design would be unacceptable for continuous-shot railguns.

Figure 7:
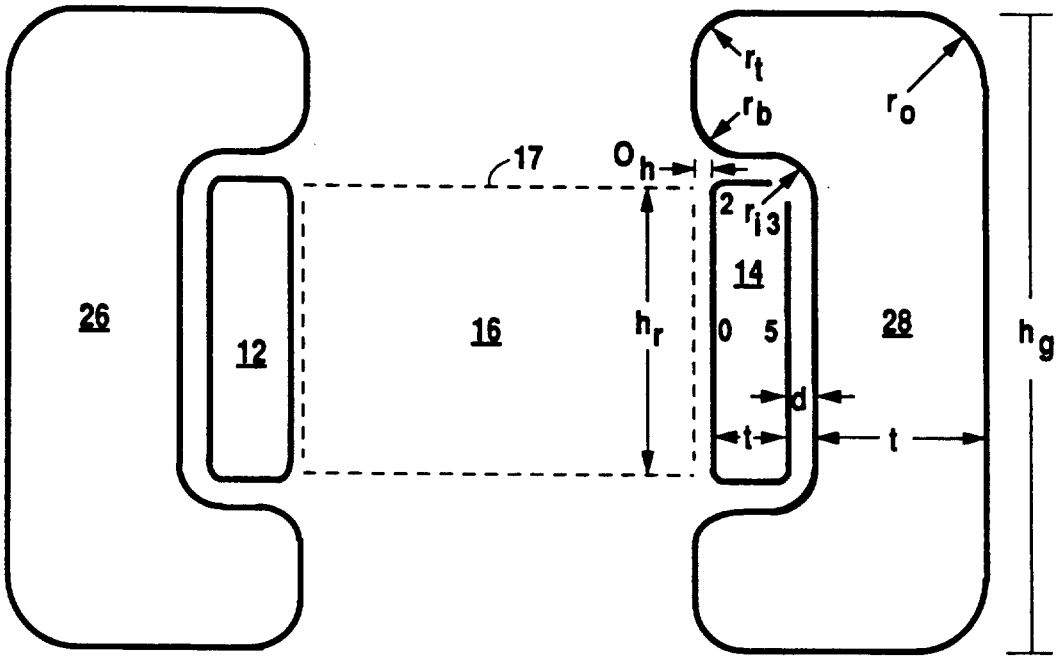
FIG. 7 is an end view of a square bore electromagnetic projectile launcher having a pair of guard plates according to the present invention.

FIG. 7 is an end view of an electromagnetic projectile launcher having guard plates 26 and 28 of the present invention. Guard plates 26 and 28 are situated adjacent to the exterior, top and bottom surfaces of rails 12 and 14. The inside surfaces of rails 12 and 14 define a square bore 16 through which projectile 17 is propelled. The ends of each guard plate have a protrusion that extends inward to a point flush with the interior surface of rails 12 and 14. As in conventionally augmented railguns, each guard plate carries current in the same direction as the adjacent rail, but can be powered either in series with the rail or independently. The interaction of guard plate current and rail current causes the rail current to be more uniformly distributed across the inside face of the rail.

Separately powered guard plates (not in series with the rails but carrying current in the same direction as the adjacent rail) allow optional control of the rail current distribution.

Figure 8:
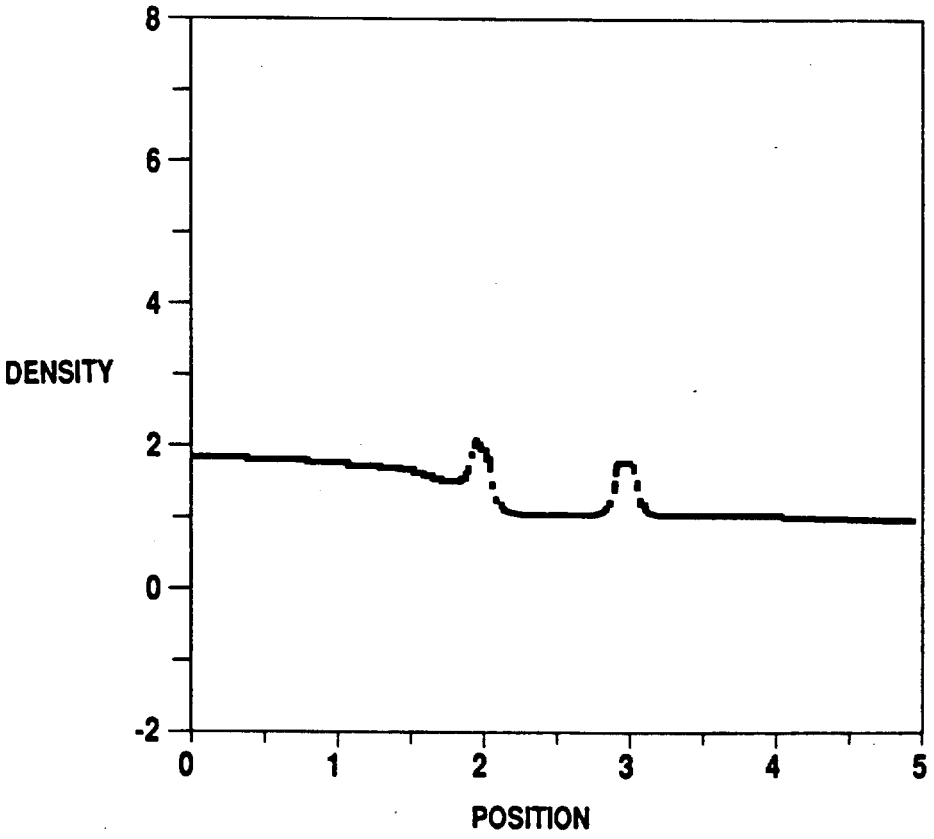
FIG. 8 is a graph of a numerical example of normalized peak current density along the rail surface of the electromagnetic projectile launcher of FIG. 7.

As shown in the numerical example of FIG. 8, the normalized current density of a square bore projectile launcher having guard plates is fairly even throughout the rail surface. The peak current densities at the inside and outside corners are significantly lower than the conventional augmented designs. The current density at the corners (near positions 2 and 3) is slightly over 2 times that at the middle outside surface (position 5). The current distribution along the projectile interface (i.e., along the bore or interior surface of the rails) is relatively constant without having large local current peaks. Evenly dispersed current at the projectile-rail interface will allow employment of continuously firing projectile launchers with significantly reduced rail damage. Moreover, as shown below Table II, guard plates of the present invention can increase projectile force by 6–7 times that of conventional augmented railguns operating with the same limitation on local peak current density.

Figure 9:
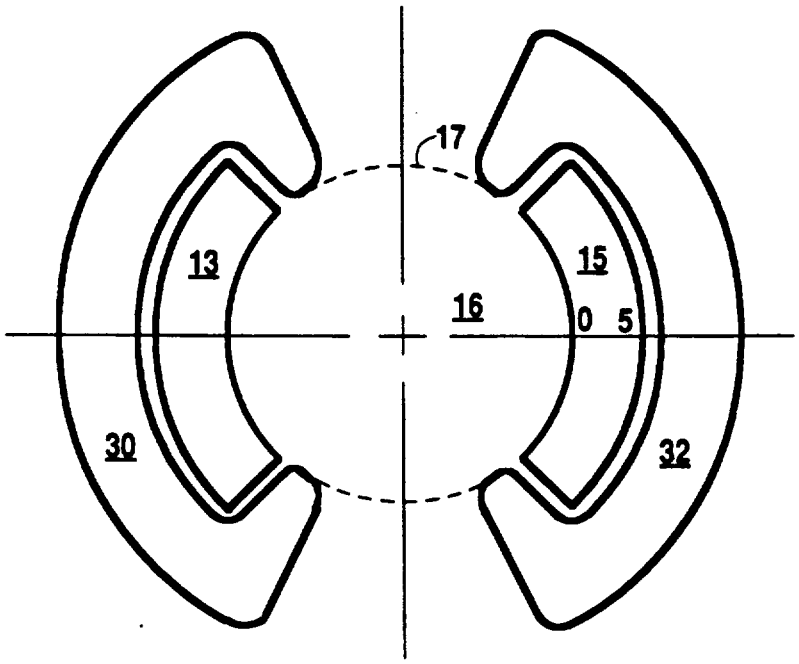
FIG. 9 is an end view of a round bore electromagnetic projectile launcher having a pair of inner arcuate rails surrounded by guard plates according to the present invention.

FIG. 9 is an end view of an electromagnetic projectile launcher of the present invention, having a pair of inner arcuate rails 13 and 15 and a pair of outer arcuate guard plates 30 and 32. Guard plates 30 and 32 are placed adjacent to the non-interior surface of rails 13 and 15. The interior surfaces of rails 13 and 15 define round-bore 16 through which projectile 17 is propelled. The ends of each guard plate have protrusions which extend inward flush with the interior surface (i.e., no overhang) of rails 13 and 15. By electrically charging the guard plates and rails, current is dispersed evenly on the rail surface.

Figure 10:
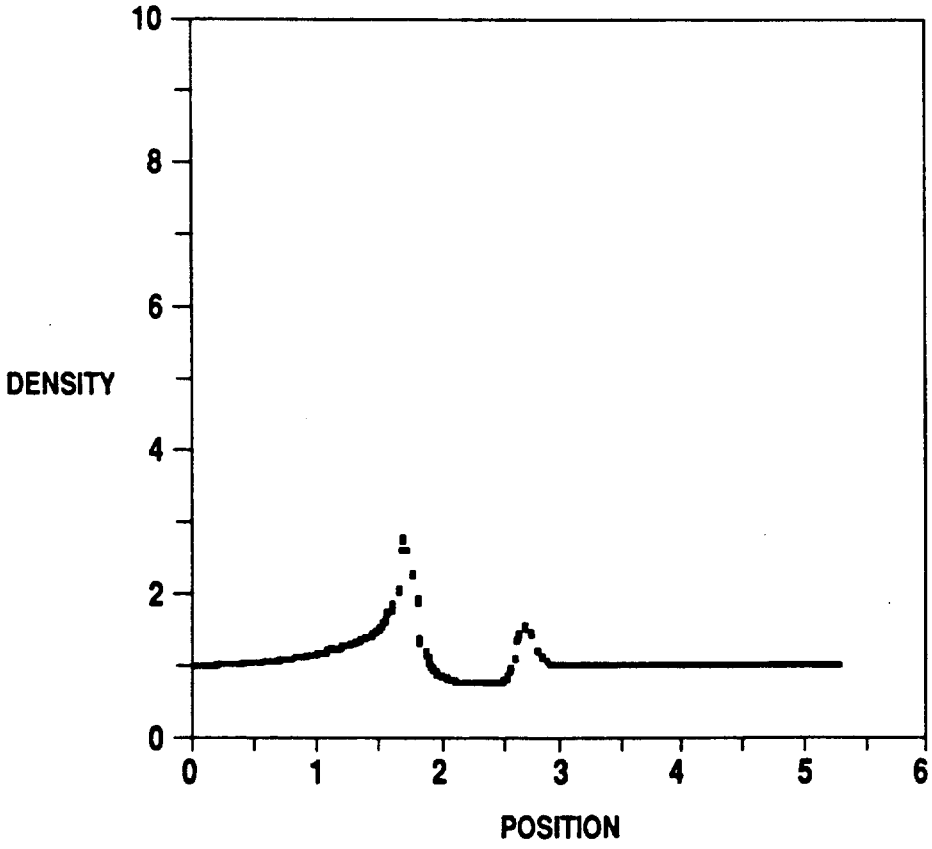
FIG. 10 is a graph of a numerical example of normalized peak current density along the arcuate rail surface of the electromagnetic projectile launcher of FIG. 9.

FIG. 10 illustrates a numerical example of the resultant normalized current density of the round-bore launcher of FIG. 9, having a pair of arcuate guard plates of the present invention. The current density peaks at the corners of the rails (near positions 2 and 3). Peak current magnitude at the inside corner being approximately 3.2 times that of the backside center position 5. The peak current magnitude at the outside corner is less than 2 times that of the backside center position 5.

Figure 11:
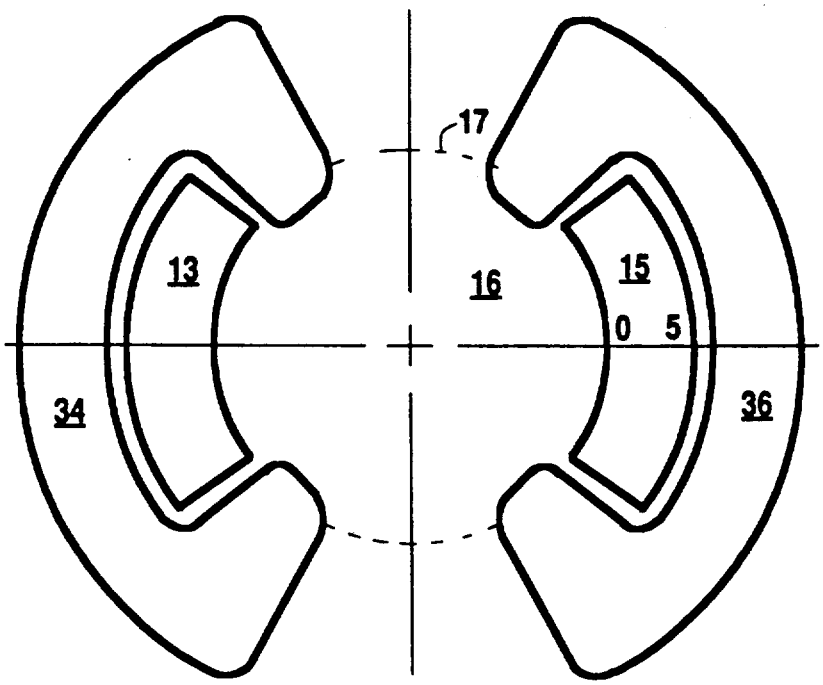
FIG. 11 is an end view of another embodiment of a round bore electromagnetic projectile launcher according to the present invention.

FIG. 11 is an end view of an electromagnetic projective launcher of the present invention having a pair of inner arcuate rails 13 and 15 and a pair outer arcuate guard plates 34 and 36. The ends of each guard plate having a protrusion which extends radially inward beyond the interior surface of rails 13 and 15 (i.e., with overhang). The protrusion extends into round-bore region 16 so as to define projectile 17. The round-bore design of FIG. 11 is similar to the round-bore of FIG. 9, however, FIG. 11 employs the overhang feature which more effectively disperses current density away from the inside corners of the rails than when no overhang is featured.

Figure 12:
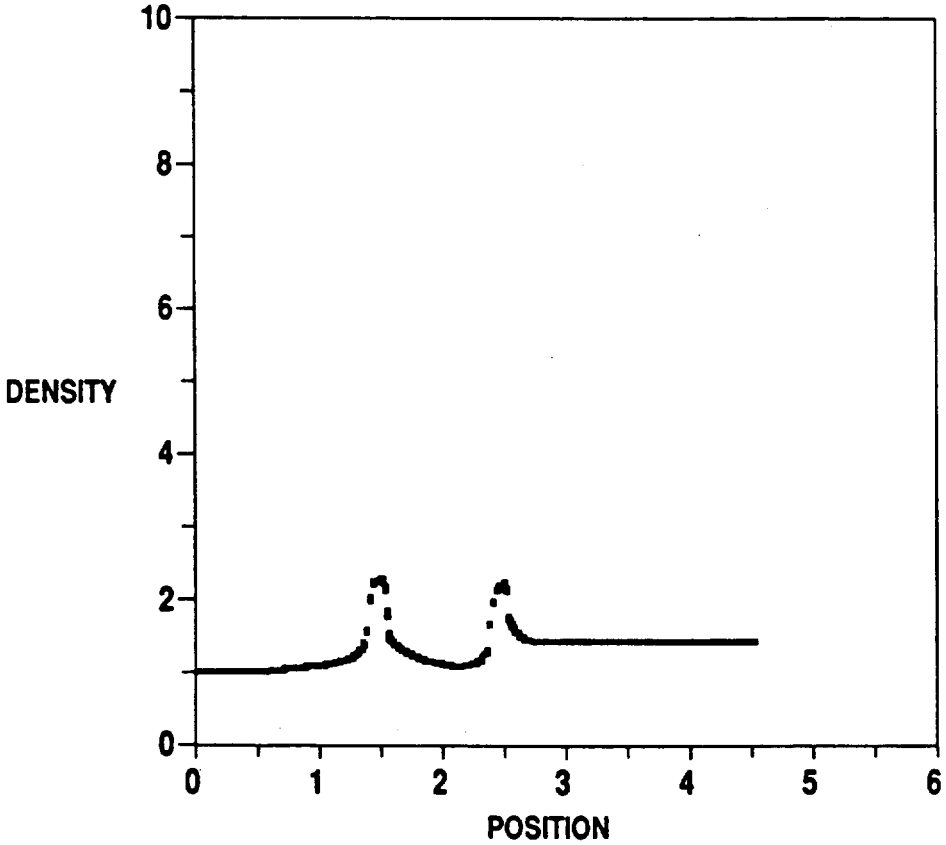
FIG. 12 is a graph of a numerical example of normalized peak current density along the arcuate rail surface of the electromagnetic projectile launcher of FIG. 11.

FIG. 12 is a graph of a numerical example illustrating the advantage of using guard rails having an overhang of the present invention. The overhang functions to reduce normalized peak current density at the inside corner from approximately 3.2, as shown in FIG. 10, to 2.3 as shown in FIG. 12. Conversely, normalized current density on the outside corner is increased from approximately 1.9 to 2.3. The overhang design thereby functions to equalize and fix the peak current magnitude at the rail corners at 2.3 times the central backside position 5.

Figure 13:
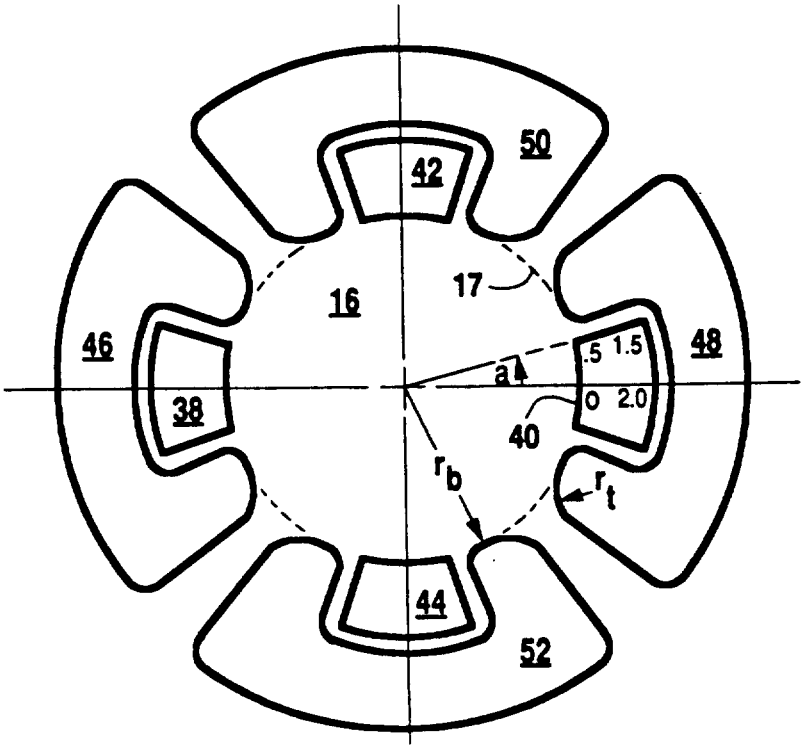
FIG. 13 is an end view of a round bore electromagnetic projectile launcher having two pairs of inner arcuate rails surrounded by two pairs of guard plates according to the present invention.

FIG. 13 is an end view of an electromagnetic projectile launcher having two pairs of rails 38, 40, 42 and 44, and two pairs of guard plates 46, 48, 50 and 52. Guard plates 46, 48, 50 and 52 lie adjacent to non-interior surfaces of rails 38, 40, 42 and 44, respectively. Each guard plate has a protrusion extending flush with the interior surface of rails 38, 40, 42 and 44. Although two pairs of rails and accompanying guard plates are shown, it is understood that more than two pairs can be used. In FIGS. 13–16, position 2 is the middle of the outside surface of rail 40. Once again, each rail exhibits symmetrical current density characteristics.

Figure 14:
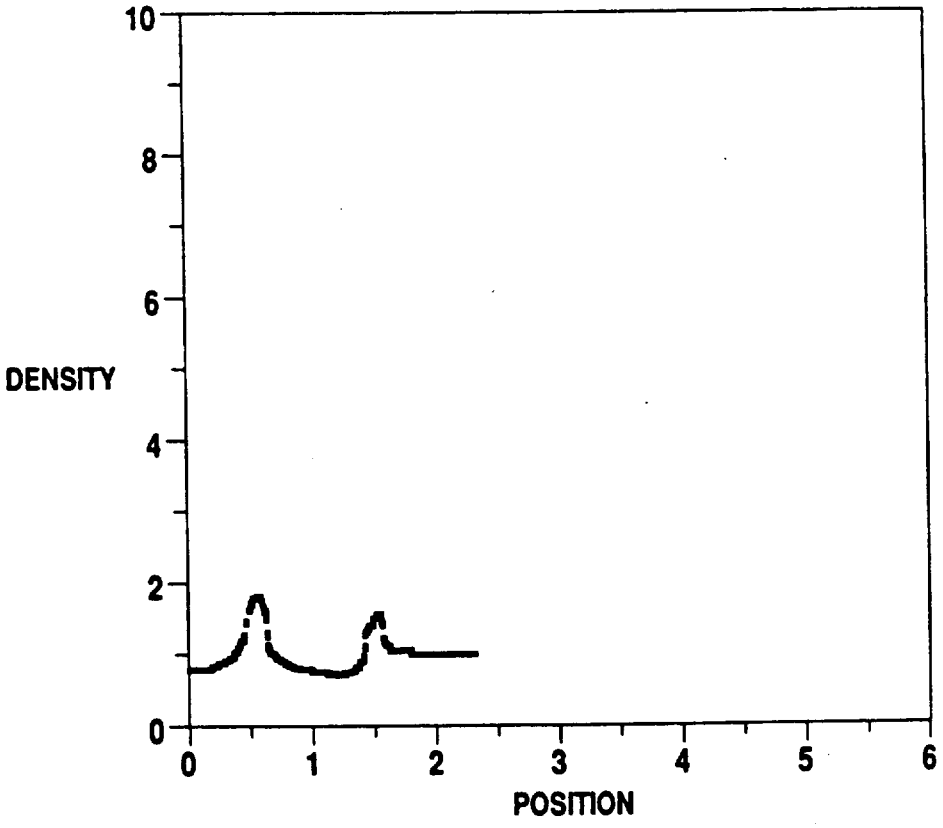
FIG. 14 is a graph of a numerical example of normalized peak current density along the arcuate rail surface of the electromagnetic projectile launcher of FIG. 13.

As shown in the numerical example of FIG. 14, the normalized current density of the railgun of FIG. 13 peaks at 2 times the current density on the middle backside position 2. Current density peaks remain on the inside and outside corners of the rails (i.e., near positions 0.5 and 1.5, respectively), however, the current density peaks are significantly lower than the single-pair configuration of FIG. 9.

Figure 15:
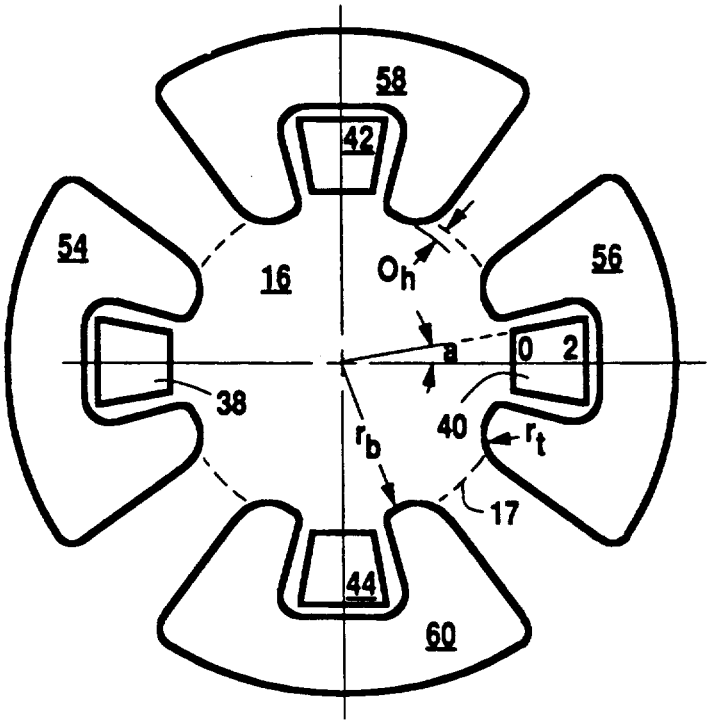
FIG. 15 is an end view of another embodiment of a round bore electromagnetic projectile launcher having two pairs of inner arcuate rails surrounded by two pairs of outer guard plates according to the present invention.
Figure 16:
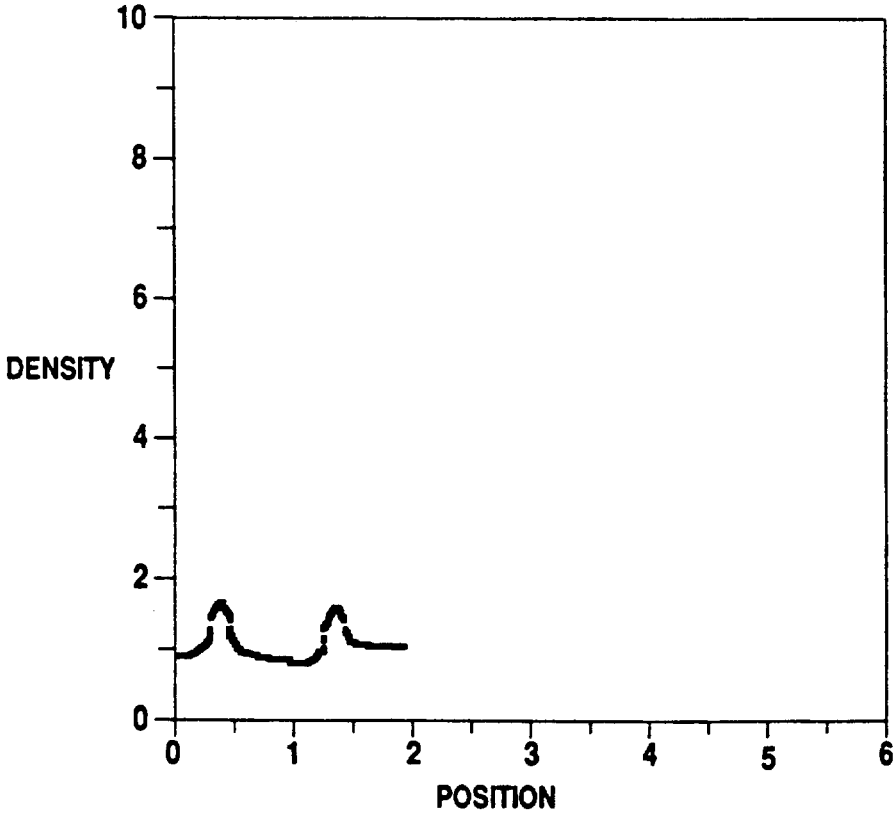
FIG. 16 is a graph of a numerical example of normalized peak current density along the arcuate rail surface of the electromagnetic projectile launcher of FIG. 15.

FIG. 15 is an end view of an electromagnetic projectile launcher having two pairs of guard plates 54, 56, 58 and 60 surrounding the non-interior surfaces of rails 38, 40, 42 and 44, respectively. In this instance, guard plate protrusions extend inward, beyond the interior surfaces of rails 38, 40, 42 and 44. The protrusion and accompanying overhang extends into the bore region 16. As illustrated in the numerical example of FIG. 16, the overhang feature produces current density peaks at the inside and outside rail corners of less than 2 times the current density on the middle backside position 2.

Figure 17:
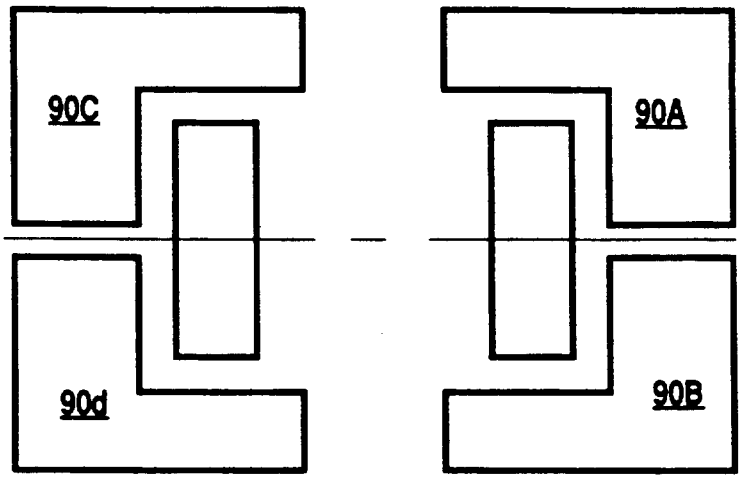
FIG. 17 is an end view of another embodiment of a square bore electromagnetic projectile launcher having a split guard plate.

FIG. 17 is an end view of another embodiment of a square bore electromagnetic projectile launcher having split guard plates 90*a, b, c, d*. This important alternative embodiment showing a geometric variation on the guard plate design is to split each guard plate in half so that the series-connected guard plates can have a total guard current equal to twice the rail current without needing two power supplies. The upper guard plates 90*a* and 90*c*, are connected in series with the lower guard plates 90*b* and 90*d*. By splitting each guard plate, total guard current can equal twice the rail current to achieve greater projectile velocities in a simple series fed rail/guard plate system.

Figure 18:
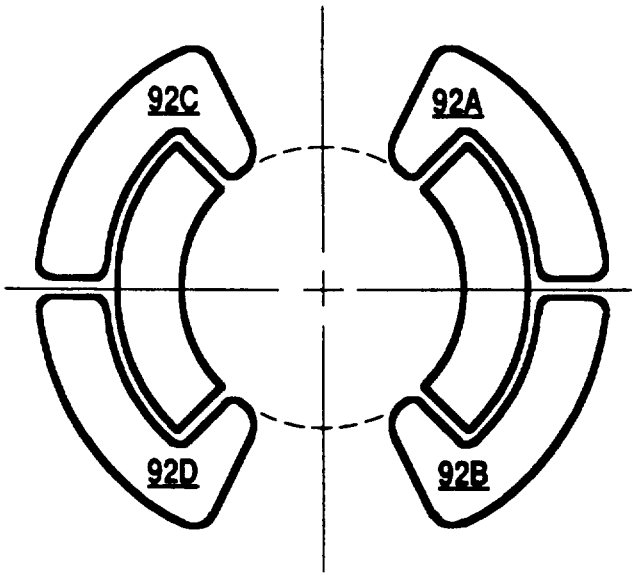
FIG. 18 is an end view of another embodiment of a round bore electromagnetic projectile launcher having a split guard plate.

FIG. 18 illustrates split guard plates in a roundbore configuration. Similar to the square-bore design of FIG. 17, arcuate round-bore guard plates 92*a, b, c* and *d* are used to achieve improved guard plate-to-rails current ratios, whereby projectile forces can be maximized. Extending this concept, each guard plate can be segmented into an appropriate number of slices in order to produce a series-based system with a nearly optimum ratio of guard current to rail current. For this design, the slices need to be proportionally sized so that the resulting net current distribution on the system of segmented guard plate slices is nearly identical to the current distribution of the optimum non-segmented guard plate. It is important to note that split guard plates can have either overhang or non-overhang and can be embodied in a single pair shown in FIGS. 17 and 18 or multiple pairs of guard plates and rails.

Figure 19:
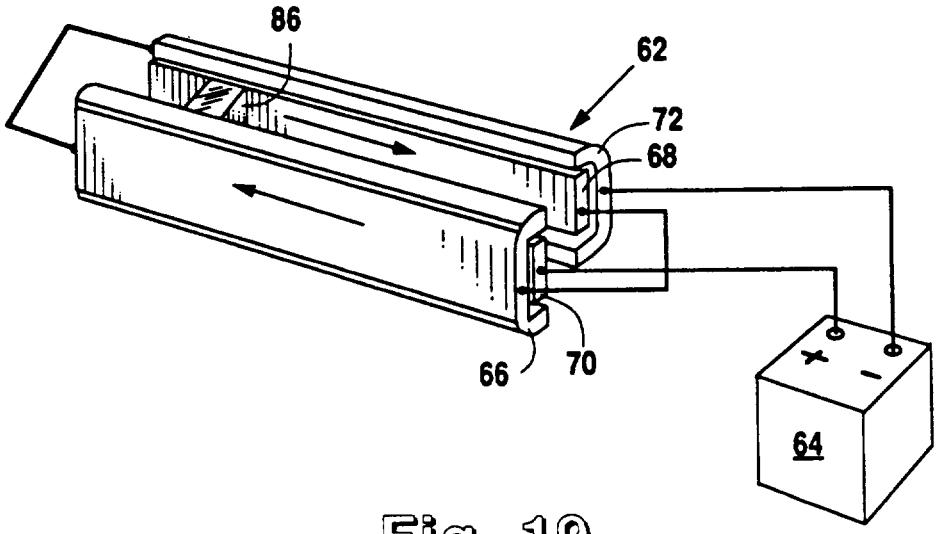
FIG. 19 is a perspective view of a square bore electromagnetic projectile launcher according to the present invention having a single power supply connecting the rails and guard plates in series.

In either the round-bore embodiment (having one or multiple pairs of guard plates and rails) or the square-bore embodiment, the guard plates can be either connected in series with the rails or they can be independently wired. FIG. 19 illustrates series-connected guard plates and rails of a square bore electromagnetic projectile launcher 62. Connected to projectile launcher 62 is a single power supply 64 capable of producing pulsed signals from its positive and negative terminals. The positive terminal of power supply 64 is connected to one end of rail 70 and the end of rail 68 is series connected to guard plate 66. Guard plate 66 is connected to guard plate 72 at the muzzle and connected to the negative terminal of power supply 64 at the breech. Sliding armature (projectile) 86 completes the current path between rails 70 and 72. The wiring configuration of FIG. 19 illustrates one embodiment for series connecting rails and guard plates of a square bore electromagnetic projectile launcher 62.

Figure 20:
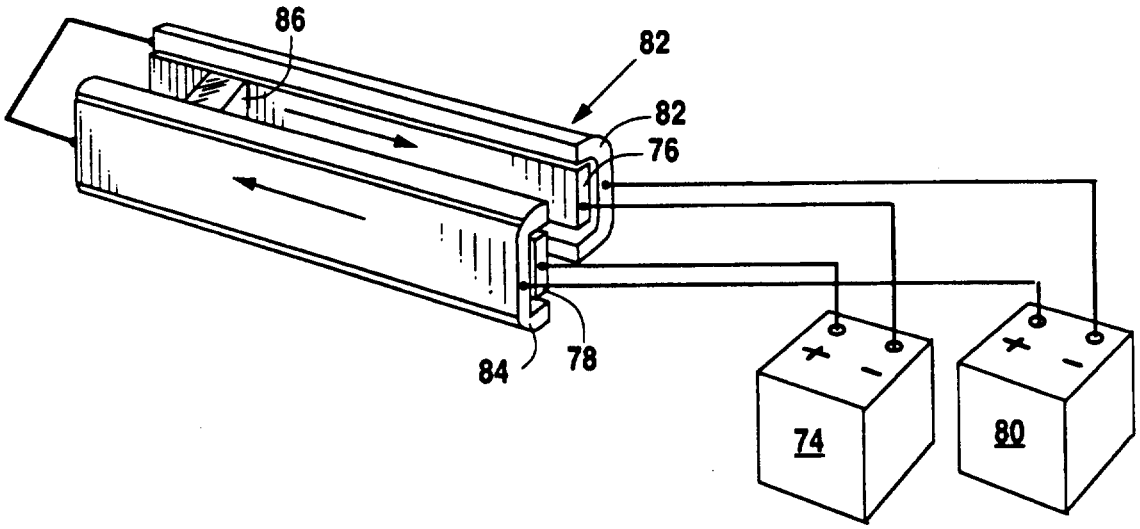
FIG. 20 is a perspective view of a square bore electromagnetic projectile launcher according to the present invention having two power supplies independently connecting the rails and guard plates.

FIG. 20 illustrates a second embodiment, wherein the guard plates and rails are connected independent of one another. Pulsed power supply 74 is shown connected to both rails 76 and 78. Pulsed power supply 80 is shown connected to both guard plates 82 and 84. Once again, sliding armature 86 completes the current path between rail pair 76 and 78. Armature 86 conducts current as indicated by the arrows in FIG. 19 and FIG. 20. The surrounding guard plates provide extra current conducting surfaces which increase the magnetic field in the railgun bore thereby adding to the electromagnetic forces applied to projectile 86. In order to optimize projectile forces, double power supplies shown in FIG. 20 are preferred. By supplying more current to guard plate pair 82 and 84 than to rail pair 76 and 78 (i.e., from 1 to 7 times the total rail current), projectile velocities can be increased by a factor of seven times that of series-connected augmenting conductors and rails, without increasing local peak current densities. Increasing guard plate current independent from rail current can easily be achieved by supplying more current from supply 80 than from supply 74. In FIGS. 19 and 20, pulsed power supplies 64, 74 and 80 can be, for example, a compulsator as disclosed in U.S. Pat. No. 4,200,831, the disclosure of which is incorporated herein by reference.

The guard plate design in a square-bore railgun has many advantages over the conventional non-augmented square-bore railgun shown in FIG. 1 and the conventional augmented square-bore railgun shown in FIG. 3. Guard plates not only disperse current more evenly throughout the rail surfaces, but they also amplify electromagnetic force applied to the projectile. Projectile forces can be increased significantly over conventional augmented and non-augmented designs. The following Table II illustrates a numerical comparison between augmented, non-augmented, and guard plate square-bore railgun designs.

TABLE II

| Augmented, Non-Augmented and Guard Plate Square-Bore Railgun Performance | | | |
|---|---|---|---|
| Parameter | Force (MN) | Guard Current (MA) | Rail Current (MA) |
| Railgun with Guard Plates | 3.240 | 2.311 | 2.535 |
| Augmented Railgun | 0.543 | 0.961 | 0.961 |
| Non-Augmented Railgun | 0.393 | — | 1.224 |

Results presented in Table II are for non-augmented, augmented and guard plate square-bore railgun designs shown in FIGS. 1, 3 and 7, respectively. For the augmented and non-augmented entries of Table II, the dimensions are the same as those presented above with reference to Table I. For the guard plate entry of Table II, with reference to FIG. 7, rail height, $h_r$, is 4.0 cm, and guard plate height, $h_g$, is 6.4 cm. Also, rail thickness, and guard plate thickness, t, are each 1.0 cm. Distance, d, between rails and outside guard plates is 2.0 mm. Therefore, as can be shown by comparing FIG. 1, 3 and 7, geometric shapes are held constant so that relative comparisons shown in Table II can be accurate. The railgun with guard plates, shown in FIG. 7 and used in Table II, is force-optimized by fixing, $r_t$, $r_b$ and $r_o$ at 0.573, 0.427, and 1.3 cm respectfully. Furthermore, $r_i$ is set at 0.3 cm. By rounding the corners and fixing the inside and outside radii at the designated amounts, peak current density is further evenly distributed away from the rail corners. An even current distribution is aided by placing a slight overhang at opposite inside ends of each guard plate. Using a 4.0 cm×4.0 cm bore, protrusion or overhang, $o_h$, can be set at 0.573 cm so that the resultant normalized current density shown in FIG. 8 and resultant force shown in Table II can be produced.

If the guard plates are designed such that they overhang the interior surface of the rails, as shown in FIGS. 7, 11 and 15, current density at the interior rail corners can be greatly decreased. The overhang feature aids in reducing current densities at the corners of the interior rail surface. If an overhang is used, more total current can be sent to the rails and guard plates without increasing maximum local current density on the rail surfaces. The following Table III illustrates numerical examples of the advantages of the overhang feature in a round-bore guard plate design. For these computations, local guard plate peak current densities were limited to 1.5 MA/in. or 2.0 MA/in. while local rail peak current density was limited to 1 MA/in.

TABLE III

| Guard Plate, Two Rail, Round-Bore Railgun Performance | | | | |
|---|---|---|---|---|
| Max Guard Density (Ma/in) | Overhang (cm) | Force (MN) | Guard Current (MA) | Rail Current (MA) |
| 1.5 | 0.0 | 1.506 | 2.33 | 1.593 |
| 2.0 | 0.0 | 1.585 | 2.850 | 1.647 |
| 1.5 | 0.228 | 1.925 | 2.120 | 1.814 |
| 2.0 | 0.289 | 2.489 | 2.946 | 2.137 |

Results presented in Table III are for one pair of opposed rails and guard plates surrounding a round bore shown in FIGS. 9 and 11. FIG. 13 illustrates a round-bore design having four guard plates and accompanying rails wherein the guard plates do not overhang into the bore region. Angle a is 14.26 degrees, rail bore radius, $r_b$, is 2.257 cm, and guard plate inside radius, $r_t$ is 0.642 cm. The overhang design in FIG. 15 has angle a fixed at 9.93°, rail bore radius, $r_b$ equal to 2.057 cm, and guard plate inside radius, $r_t$ equal to 0.650 cm. By reducing $r_b$ and angle a, protrusion or overhang, $o_h$ is fixed at 0.199 cm. Using the geometrical figures given, designs for round bore railguns having four guard plates, one without overhang and one with overhang presented in Table IV, can be compared with the numerical examples given in Table III.

TABLE IV

| Guard Plate, Four Rail, Round-Bore Railgun Performance | | | | |
|---|---|---|---|---|
| Max Guard Plate Current Density (MA/in) | Overhang (cm) | Force (MN) | Guard Current (MA) | Rail Current (MA) |
| 1.5 | 0.0 | 0.947 | 4.205 | 1.891 |
| 2.0 | 0.0 | 1.059 | 5.695 | 2.008 |
| 1.5 | 0.131 | 0.999 | 4.489 | 1.746 |
| 2.0 | 0.199 | 1.232 | 6.290 | 1.864 |

It is understood that the invention is not confined to the particular construction set forth herein, but embraces each modified forms thereof as come within the scope of the following claims.

What is claimed is:

1. An electromagnetic projectile launcher comprising:

at least one pair of arcuate rails, each pair of rails extending along a central axis substantially parallel to one another, each rail having an interior, exterior, top and bottom surface, said interior surfaces of the rails together defining a substantially round-bore region having a bore diameter equal to a spacing between rail pairs and having a bore length equal to a length of the rails;

a plurality of C-shaped arcuate guard plates, each guard plate extending substantially parallel to said central axis, each said guard plate having an interior and an exterior surface, said interior surface of each guard plate being insulated from, but disposed adjacent to and spaced from the exterior, top and bottom surfaces of a respective rail; and a protrusion at opposite ends of each said guard plate extending along the length of said guard plate, said protrusion extending inward toward said bore region beyond said interior surface of the respective rail.

2. An electromagnetic projectile launcher comprising:

a pair of arcuate rails, each said rail extending parallel to one another and having an interior, exterior, top and bottom surface, said interior surface of the rails defining a substantially round-bore region having a bore diameter equal to a spacing between said rails and having a bore length equal to a length of said rails;

a pair of arcuate guard plates, each guard plate extending substantially parallel to said rails, and having an interior and exterior surface, said interior surface of each guard plate being insulated from, but disposed adjacent to and spaced from the exterior, top and bottom surfaces of a respective rail;

a primary source of pulsed current connected to said pairs of rails and guard plates;

a projectile disposed within said bore region and in slideable contact with said interior surfaces of said pair of arcuate rails; and a protrusion at opposite ends of each guard plate axially extending along the length of said guard plate, said protrusion extending toward and into said bore region.

* * * * *